US006747409B1

(12) United States Patent
Han et al.

(10) Patent No.: US 6,747,409 B1
(45) Date of Patent: Jun. 8, 2004

(54) PLASMA DISPLAY PANEL WITHOUT TRANSPARENT ELECTRODE

(75) Inventors: Seong-Hoon Han, Kawasaki (JP); Dong-Ki Oh, Kawasaki (JP); Bok-Sik Song, Kawasaki (JP)

(73) Assignee: Hyundai Plaxma Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/335,208

(22) Filed: Dec. 30, 2002

(30) Foreign Application Priority Data

Dec. 12, 2002 (KR) ..... 10-2002-0079189

(51) Int. Cl.[7] ..... H01J 17/49

(52) U.S. Cl. ..... 313/582; 313/583; 313/586; 313/292

(58) Field of Search ..... 313/582, 586, 313/292, 268

*Primary Examiner*—Vip Patel

(74) *Attorney, Agent, or Firm*—Sheridan Ross PC

(57) ABSTRACT

The present invention provides a plasma display panel (PDP) capable of simplifying the number of processes, reducing costs for materials, improving an exhausting function and preventing erroneous discharge and cross-talk phenomena between neighboring cells. The present invention provides a plasma display panel (PDP), including: a vertical barrier rib and a horizontal barrier rib, wherein the vertical barrier rib and the horizontal barrier rib form a hexagonal shape to encompass discharge cell region in all directions; a connection barrier rib connecting the vertical barrier rib to the horizontal barrier rib, wherein the connection barrier rib have a groove at a central portion thereof so that a length of the horizontal barrier rib is shorter than a distance between the vertical barrier ribs, and a gas-passing path formed above a top surface of the horizontal barrier rib of which height is lowered with respect to a surface of the vertical barrier rib.

13 Claims, 7 Drawing Sheets

PLASMA DISPLAY PANEL WITHOUT TRANSPARENT ELECTRODE

FIELD OF THE INVENTION

The present invention relates to a plasma display panel (PDP), and, more particularly, to a PDP improved with rightness.

DESCRIPTION OF RELATED ARTS

Plasma display panel (hereinafter referred as to PDP) is a flat board display device using the effect of vacuum ultraviolet rays that excites red (R), green (G) and blue (B) fluorescent substances and subsequently generates visible rays. The vacuum ultraviolet rays are emitted from plasma generated during the discharge out as, such as Ne or Xe, filled in a space between the front plate and the rear plate.

PDP is divided into a direct current (DC) type and an alternating current (AC) type. In a DC-type PDP, an electrode used to supply voltage from outside to form plasma is exposed directly to the plasma and the conduction current flows directly through the electrode. It has an advantage that the structure is very simple, but has a disadvantage that it should equip external resistance to limit the current because the electrode is exposed in the discharge space.

In an AC-type PDP, an electrode is not exposed directly but covered with a dielectric substance, so displacement current flows. Since the electrode is covered with a dielectric substance, electric current can be limited naturally. Also, because the electrode can be protected from ion impact during the discharge, the AC-type PDP has a longer lifetime compared to the DC-type PDP.

The AC-type PDP can be classified into an opposite discharge type and a surface discharge type. The opposite discharge type has a problem that the life span is short due to degradation of fluorescent substances caused by the ion impact. In the surface discharge type, on the other hand, the discharge is collected in a panel opposite to the fluorescent substances in order to minimize the degradation of fluorescent substances and thus overcome the structural disadvantage of the opposite discharge type. Nowadays, most PDP devices adopt the surface discharge type.

Meanwhile, among various flat display devices, the PDP can easily realize a wider and thinner screen. Because of this advantage, the PDP in today has broad applications by being increasingly used for a real time display screen in stock trading markets, a display screen for a conference and a wall frame television with a wide screen.

FIG. 1 is a diagram showing a layout of a surface discharging AC type PDP using three electrodes. Particularly, the diagram in FIG. 1 shows an array of the electrodes.

Referring to FIG. 1, the surface discharging AC type PDP includes a front substrate 11 and a rear substrate 11A. An X electrode 12 and a Y electrode 13 are formed in a row direction. An address electrode 14 is formed in a direction where the X electrode 12 and the Y electrode 13 cross to each other.

Also, a cell 15 is constructed on a point where each of the electrodes is crossing. Especially, the X electrode 12 is a scan electrode used for scanning a screen. The Y electrode 13 is a sustain electrode used for sustaining a discharging state. The address electrode 14 is used for inputting data.

The address electrode 14 formed in each cell is supplied with an address voltage by being connected to an address driver. The X electrode 12 is connected to an x electrode driver and supplied with a scan voltage. The Y electrode 13 is supplied with a sustain voltage by being connected to a Y electrode driver.

The X and Y electrodes and the address electrode are constructed and a matrix form.

FIG. 2A is a cross-sectional view of the surface discharging AC type PDP with the three electrodes in accordance with a preferred embodiment of a prior art.

Referring to FIG. 2A, the front panel includes a front electrode having a front substrate 21, a pair of transparent electrodes being positioned with a predetermined distance from the front substrate 21, a pair of bus electrodes being formed on top of each transparent electrode 22, a transparent dielectric layer 23 limiting discharge current-by being formed on the front electrode, a protection layer 24 for protecting the transparent dielectric layer 23 being formed beneath the transparent dielectric layer 23. The front electrode constitutes X and Y electrodes shown in FIG. 1. For example, one transparent electrode 22 and the bus electrode 22A constitute the X electrode while the other transparent electrode 22 and the bus electrode 22A constitute the Y electrode.

A rear panel includes a rear substrate 21A, an address electrode 25 formed on the rear substrate 21A in a direction of acrossing the front electrode, a white dielectric layer 26 for protecting the address electrode 25 and simultaneously reflecting visible rays emitted from a discharging space 29 by being formed entirely on the rear substrate 21A including the address electrode 25, a barrier rib 27 for preventing the cross-talk phenomenon occurring between cells neighboring the address electrodes 25 being formed in a stripe shape and a fluorescent substance 28 emitting visible rays by being formed on the white dielectric layer 26 and at lateral sides of the barrier rib 27.

The discharging space 29 where inert gas is added and sealed is formed in a space provided when the front panel and the rear panel are connected.

Referentially, rig. 2A shows the front substrate 21 rotated in 90° for a conventional purpose. Discharge cells are isolated through the barrier rib 27 in a stripe shape.

The following will describe procedures until the discharge cells luminesce based on the above structure of the PDP.

Firstly, in connection with the discharge cell to be lighted, a predetermined voltage is supplied to a space between the Y electrode and the address electrode 25 so to induce discharge between the two electrodes. Due to this type of discharge, a positively ionized ion and an electron are stored into surfaces of the fluorescent substance 28 and the protection layer 24 as wall-charges.

In the discharge cell stored with the wall-charges, a voltage is supplied to the X electrode. Once the voltage is supplied, then, there occurs another discharge between the Y electrode and the X electrode.

Afterwards, the discharge occurs repeatedly due to the X and Y electrodes as they are supplied with an alternate electric field. This repeated discharge is called sustain discharge. Ultraviolet rays emitted by the sustain discharge are changed into visible rays as the ultraviolet rays excite the fluorescent substance 28. The visible rays are then transmitted through the front substrate 21 and emitted to outside.

As described in the above, a conventional PDP has the barrier rib 27 for preventing erroneous discharge between left and right cells.

Generally, the barrier rib 27 has a stripe shape being placed in a parallel direction to the address electrode 25. The conventional PDP, however, does not have a barrier rib for preventing charge movements between upper and lower calls. Therefore, a distance between the bus electrodes is set to be sufficiently large to prevent the charge movements between the upper and lower cells, thereby preventing reciprocally erroneous discharge between the cells.

The barrier rip having the strip shape is compelled to isolate each cell into two regions. That is, the two, regions are isolated into a section including a transparent electrode causing ultraviolet rays emitted due to the main discharge to react with a fluorescent substance so to emit visible rays and a black stripe region for preventing occurrences of the discharge further to prevent emission of visible rays. The region including the transparent electrode is responsible for realizing an image by emitting the visible rays.

A ratio of emitting visible rays per cell increases in proportion to an increase in an area of the discharge region in one cell. Therefore, the luminescence efficiency is also improved.

However, in the conventional PDP having the stripe shape and the barrier rib, if the area of the region for the discharge increases, there easily occurs erroneous discharge because the distance between the electrodes of the upper and the lower cells decreases. Actually, in a 40-inch VGA PDP having the barrier rib with the stripe shape, the area of the discharge region in one cell occupies only about 50%. This fact becomes a cause for decreasing the luminescence efficiency due to a decreased ratio of an actual area of the luminescence region.

Also, in case of adopting the barrier rib with the stripe shape, it is an ease of exhausting due to sufficiently attained paths for exhausting. On the other hand, ultraviolet rays emitted due to the discharge and visible rays are able to easily transmit to neighboring cells, and thus, the ultraviolet rays are dissipated. This dissipation of the ultraviolet rays further becomes a factor for decreasing brightness. Furthermore, there may occur erroneous discharge and cross-talk phenomena due to interference of charged particles of the neighboring cells. Hence, a lattice type barrier rib structure is proposed to solve the above listed problems.

FIG. 2B is a diagram showing the lattice type barrier rib proposed to solve the problems,when using the stripe type barrier rib (referred to FIGS. 4 and 5 of the Korean Patent No. 10-351846).

The lattice type barrier rib includes an array of cells, each cell being surrounded with the barrier rib so as to block the ultraviolet rays emitted due to the discharge and the visible rays from being transmitted to neighboring cells. As a result of this specific structure, it is possible to prevent occurrences of erroneous discharge and the cross-talk phenomenon due to charged particles between the neighboring cells.

Also, a dielectric layer is formed with a groove for flowing exhaust gas freely.

However, the conventional PDP with the lattice type barrier rib has an array of cells, each being blocked in all directions due to the barrier rib. Thus, this fact results in a limitation in a free flow of the exhaust gas and a complex process due to an additional process added to form the groove.

Meanwhile, the front substrate of the conventional PDP uses indium thin oxide (ITO) as a transparent electrode in order to allow visible rays to be transmitted. However, since the ITO has high electric resistance, a bus electrode using a material having a good electric conductivity such as an Ag layer and a stacked layer of Cr—Cu—Cr is formed on top of the ITO to complement the high electric resistance of the ITO.

However, the formation of the ITO electrode has a problem of increasing costs due to increases in expenses for materials and the number of processes.

SUMMARY OF THE INVENTION

It is, therefore, an object of the present invention to provide a plasma display panel (PDP) capable of preventing increases of expenses for materials and the number of processes based on a structure of the PDP including a front electrode which has a transparent electrode and a bus electrode, of improving an exhausting function and of preventing occurrences of erroneous discharge and the cross-talk phenomenon between neighboring cells.

In accordance with an aspect of the present invention, there is provided a plasma display panel (PDP), comprising: a vertical barrier rib and a horizontal barrier rib, wherein the vertical barrier rib and the horizontal barrier rib form a hexagonal shape to encompass discharge cell region in all directions; a connection barrier rib connecting the vertical barrier rib to the horizontal barrier rib, wherein the connection barrier rib have a groove at a central portion thereof so that a length of the horizontal barrier rib is shorter than a distance between the vertical barrier ribs; and a gas-passing path formed above a top surface of the horizontal barrier rib of which height is lowered with respect to a surface of the vertical barrier rib, wherein the horizontal barrier rib prevents erroneous discharge in a vertical direction, the vertical barrier rib prevents erroneous discharge in a horizontal direction and the vertical barrier rib, the horizontal barrier rib and the connection barrier rib are connected to each other to provide a hexagonal discharge cell region.

In accordance with another aspect of the present invention, there is also provided a surface discharging alternating current (AC) type plasma display panel (PDP) with three electrodes, comprising: a pair of front electrodes; and an address electrode, wherein each front electrode of a unit discharge device, including: a main electrode and a terminal electrode being paired by having a uniform distance in a direction of making a perpendicular cross at a center of the barrier rib; and a branch electrode connecting the main electrode to the terminal electrode by being formed in a parallel direction to the barrier rib at the center of the barrier rib, wherein each line width of the main electrode, the terminal electrode and the branch electrode is different, and the main electrode, the terminal electrode and the branch electrode are bus electrodes without having a transparent electrode.

In accordance with still another aspect of the present invention, there is also provided a plasma display panel, comprising a unit discharge device, wherein the unit discharge device includes: a front substrate and a rear substrate; a pair of bus electrodes in a trapezoidal shape by being formed in a first direction on the front substrate; an address electrode formed on the rear substrate in a second direction of making a cross with the pair of the bus electrodes; a dielectric layer forming on the rear substrate including the address electrode; a hexagonal barrier rib encompassing a discharge cell region defined by the pair of the bus electrodes and the address electrode and providing a gas-passing path due to a fact that a height of one side of the barrier rib is lower than that of the other side of the barrier rib; and a fluorescent substance coated on an entire area of the discharge cell region encompassed by the hexagonal barrier rib.

BRIEF DESCRIPTION OF THE DRAWING(S)

The above and other objects and features of the present invention will become apparent from the following description of the preferred embodiments given in conjunction with the accompanying drawings, in which.

DETAILED DESCRIPTION OF THE INVENTION

Figure 1:
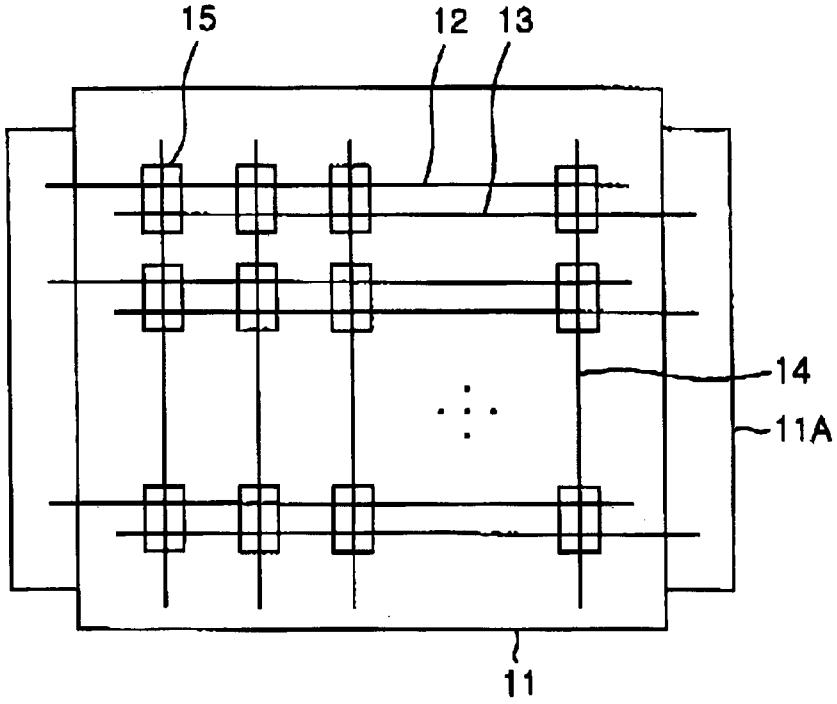
FIG. 1 (PRIOR ART)
FIG. 1 is a diagram showing a layout of a typical surface discharging alternating current (AC) type plasma display panel (PDP) having three electrodes.
Figure 2A:
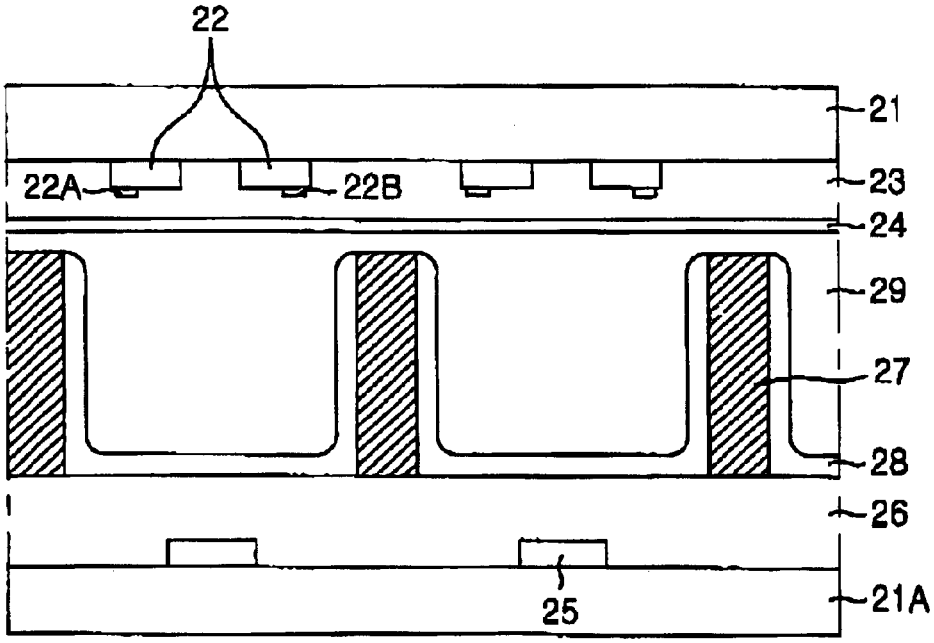
FIG. 2A (PRIOR ART)
FIG. 2A is a cross-sectional view showing the surface discharging AC type PDP having the three electrodes in accordance with a preferred embodiment of a prior art.
Figure 2B:
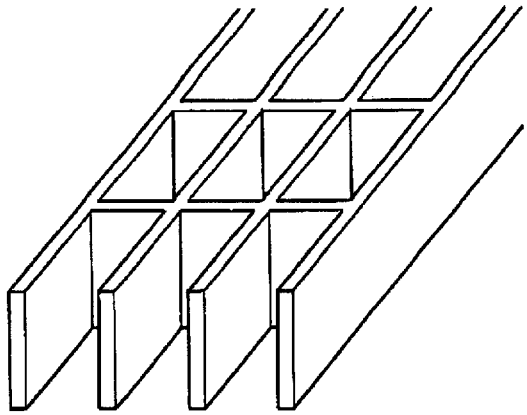
FIG. 2B (PRIOR ART)
FIG. 2B is a diagram showing a lattice type barrier rib in accordance with the prior art.
Figure 3:
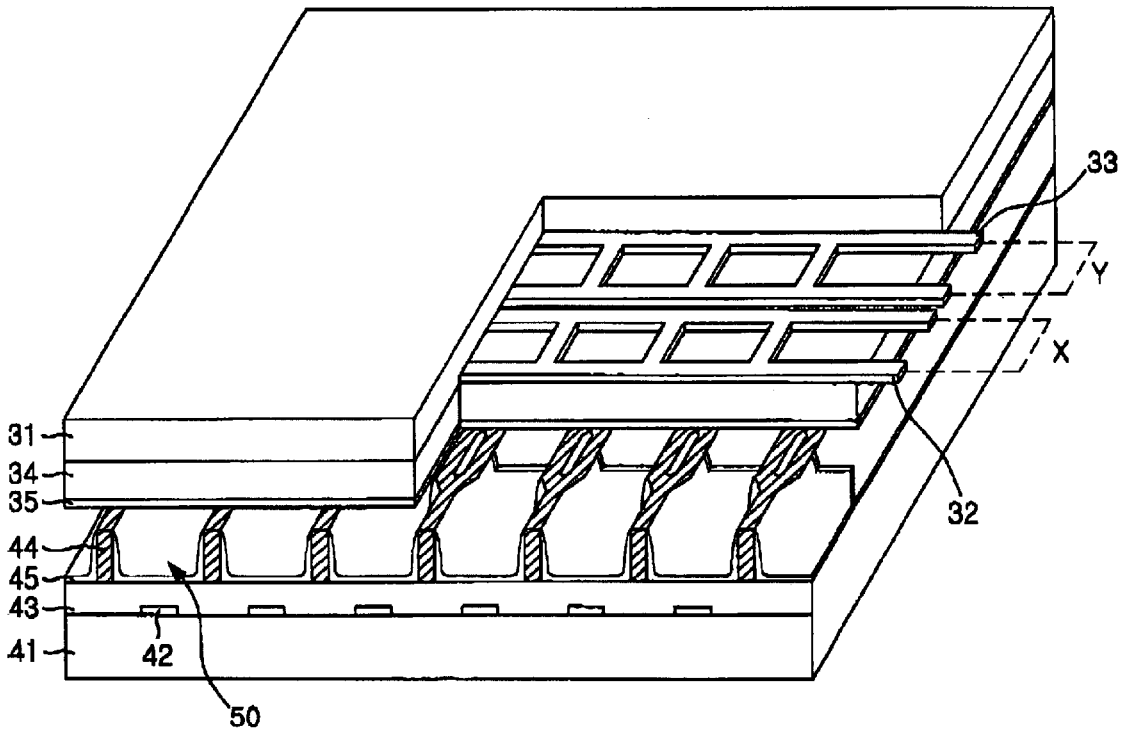
FIG. 3 is a perspective view showing partially a surface discharging AC type PDP having three electrodes in accordance with a preferred embodiment of the present inventions.

FIG. 3 is a perspective view showing partially a surface discharging AC type plasma display panel (PDP) having three electrodes in accordance with a preferred embodiment of the present invention. As illustrated in FIG. 3, the surface discharging AC type PDP includes a front panel having a front substrate 31 and a rear panel having a rear substrate 41.

First, in the front panel, front electrodes X and Y are formed entirely on the front substrate made of glass. The front electrodes X and Y are constituted only with bus electrodes 32 and 33 without a transparent electrode. The bus electrodes 32 and 33 are opaque metal including Ag, Au, Al, Cu, Cr and a stacked material of the above listed metal, e.g., a stacked structure of Cr/Cu/Cr. Also, the bus electrodes 32 and 33 have a trapezoidal shape (refer to FIG. 4). One of the front electrodes X and Y is used as a scan electrode. A transparent dielectric layer 34 on the bus electrode 32 or 33 uses a material typically used in the PDP. For instance, glass paste constructed with glass frit having a low melting point, a binder, a, solvent and so on is coated through a screen print method or a laminating method using a dielectric layer and proceeded with an annealing process so to form the transparent dielectric layer 34. On top of the transparent dielectric layer 34, a protection layer 35 for protecting the transparent dielectric layer 34 from damages due to collisions of ions generated by discharge when displaying. The protection layer 35 uses the known materials such as MgO, CaO, SrO, BaO and the like.

Next, in the rear panel, an address electrode 42 using Ag, Au, Al, Cu, Cr and a stacked material of the above listed materials, e.g., a stacked layer of Cr/Cu/Cr is formed on the rear substrate 41. A white dielectric layer 43 is formed thereon. The white dielectric layer 43 can be formed by using the same material and method for forming the transparent dielectric layer 34 of the front panel. Also, on the white dielectric layer 43, a hexagonal barrier rib 44 is formed (referred to FIG. 4). A fluorescent layer 45 is formed on the white dielectric layer 43 and at lateral sides of the hexagonal barrier rib 44.

The surface discharging AC type PDP seals surroundings by arraying the front and rear panels in an opposite direction to make the front electrodes X and Y and the address electrode 42 perpendicularly across. A discharge space 50 surrounded by the hexagonal barrier rib 44 is filled with discharge gas such as Ne and Xe. In this provided PDP, a discharge cell regions are formed at crossing portions between the address electrode 42 and all electrodes in the inter-front electrodes X-Y and the inter-front electrodes Y-X. The discharge cell region constructs one cell region which is a basic unit of display.

Figure 4:
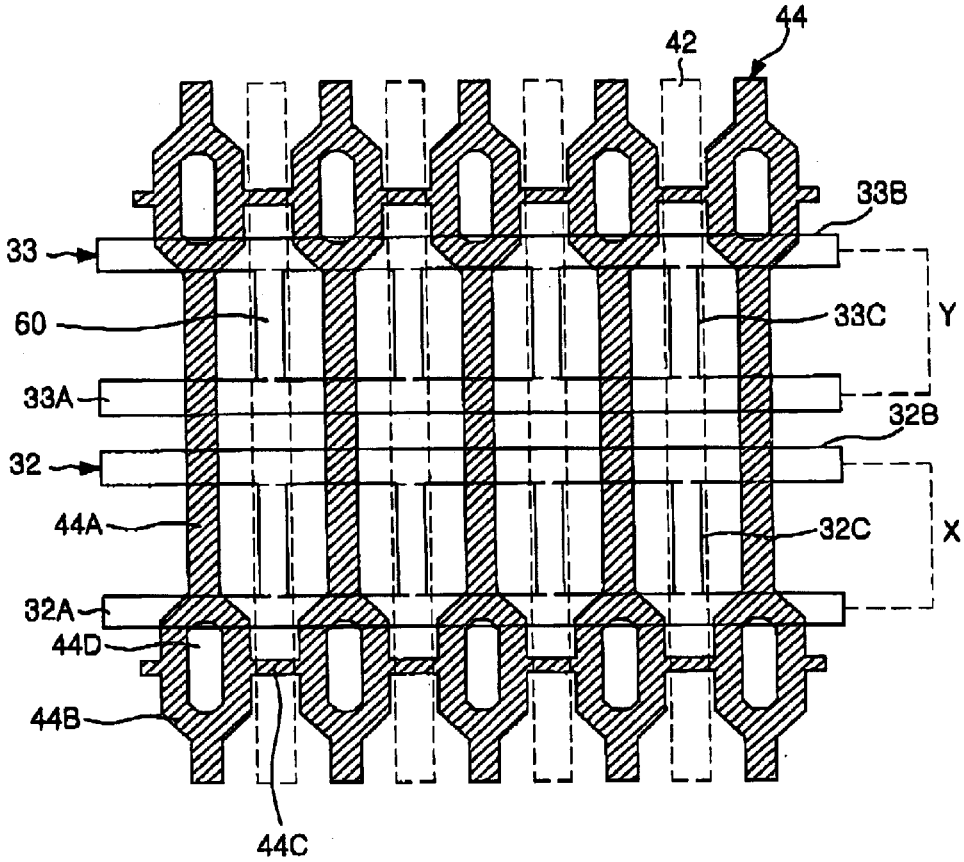
FIG. 4 is a plane view for describing an array relationship between a bus electrode, a barrier rib and an address electrode.

FIG. 4 is a plane view for describing an array relationship between the bus electrode, the barrier rib and the address electrode. On top of a hexagonal discharge cell region 60 provided from the hexagonal barrier rib 44, a pair of the trapezoidal bus electrodes 32 and 33 constituting the X and Y electrodes is arrayed in a direction of crossing with the hexagonal barrier rib 44. Also, the address electrode 42 is arrayed as by making a cross with the trapezoidal bus electrodes 32 and 33 at a point below a center of each hexagonal barrier rib 44. Particularly, the address electrode 42 can be overlapped with branched electrodes in a plane level.

Figure 5:
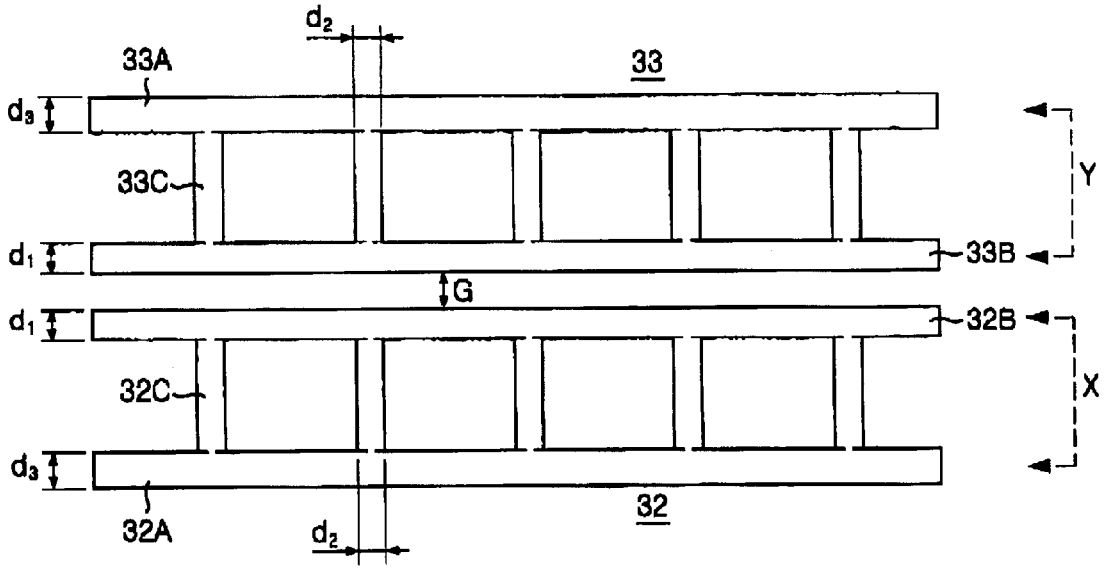
FIG. 5 is a detailed diagram showing a pair of trapezoidal bus electrodes illustrated in FIG. 4.

FIG. 5 is a detailed diagram showing the pair of the trapezoidal bus electrodes illustrated in FIG. 4.

Referring to FIG. 5, each of the trapezoidal bus electrodes 32 and 33 includes terminal electrodes 32A and 33A connecting to a terminal part, main electrodes 32B and 33D for generating discharge with neighboring electrodes, i.e., generating an initial discharge and spreading to the bus electrodes entirely and branch electrodes 32C and 33C connecting the terminal electrodes 32A and 33A to the main electrodes 32B and 33B. Especially, the branch electrodes 32C and 33C are located at a center of an upper portion of the hexagonal discharge cell region 60 provided from the hexagonal barrier rib 44. The reason for this arrangement is because the branch electrodes play an important function to provide stability of the discharge. An error of the branch electrode arrangement is set to be within a range between about −50 $\mu$m and about +50 $\mu$m measured from the central portion of the hexagonal barrier rib 44.

As explained above, the X and Y electrodes constituting the front electrode of the front panel includes only a pair of the bus electrodes 32 and 33 without having a transparent electrode. Each of the pair of the trapezoidal bus electrodes 32 and 33 includes the terminal electrodes 32A and 33A, the main electrodes 32B and 33B and the branch electrodes 32C and 33C.

Meanwhile, each of the terminal electrodes 32A and 33A pairs with each of the main electrodes 32B and 33B by being arranged with a certain distance for a discharge voltage. The pair of the bus electrodes 32 and 33 is arrayed symmetrically by facing to each other. That is the main electrode 32B of one side of the bus electrode 32 and the main electrode 33B of the other bus electrode 33 are closely located, and these main electrodes 32B and 33B form a discharge gap G. At this time, the size of the discharge gap G ranges from about 50 $\mu$m to about 80 $\mu$m.

A distance between end terminals of the two terminal electrodes 32A and 33A is set to be in a range from about 120 $\mu$m to about 150 $\mu$m. Also, each of the end terminals of the two terminal electrodes 32A and 33A is aligned ten one side of a horizontal barrier 44C of the hexagonal barrier 44. A non-discharge region provided from the two terminals 32A and 33A is defined only by a thin thickness of the horizontal barrier 44C, and thus, it is possible to enlarge areas of the discharge cell region.

In the mean time, each electrode 32A, 32B, 32C, 33A, 33B and 33C of the two bus electrodes has a line width controlled for improving an opening ratio and stabilizing the discharge.

With respect to the main electrodes 32B and 33B, the discharge occurs differently in accordance with each electrode line width $d_1$ of the main electrodes 32B and 33B. For instance, the discharge is increasingly stabilized as each electrode line width $d_1$ of the main electrodes 32B and 33B increases. Contrarily, brightness of the whole panel decreases due to a decrease of the opening ratio. As each electrode line width $d_1$ of the main electrode 32B and 33B becomes smaller, the opening ratio is excellent but the discharge is destabilized. Hence, it is preferable to set each electrode line width $d_1$ of the two main electrodes 32B and 33B to range from about 60 $\mu$m to about 80 $\mu$m in order to increase the brightness and stabilize the discharge.

With respect to the branch electrodes 32C and 33C, the two branch electrodes 32C and 33C connect the terminal electrodes 32A and 33A to the main electrodes 32B and 33B, respectively. Also, the branch electrodes 32C and 33C act to induce the discharge to be spread to end parts of the line width of the bus electrode. In other words, the branch electrodes 32C and 33C act to spread the discharge equally to the whole cell. Therefore, a thickness of the branch electrode is set to be thinner as much as possible, and preferably, each line width da of, the branch electrodes 32C and 33C ranges from about 40 $\mu$m to about 60 $\mu$m.

Each line width $d_3$ of the terminal electrodes 32A and 33A preferably ranges from about 60 $\mu$m to about 80 $\mu$m, and placed with a distance of about 100 $\mu$m from the horizontal barrier 44C of the hexagonal barrier rib 44.

The following will describe operations of the two bus electrodes 32 and 33. A voltage supplied to the terminal electrodes 32A and 33A is supplied to the main electrodes 32B and 33B along the branch electrodes 32C and 33C. Once the voltage reaches to a voltage sufficient for discharging, the discharge is started to occur strongly in between the main electrodes 32B and 33B, and spreads to the terminal electrodes 32A and 33A along the branch electrodes 32C and 33C. Then, ultraviolet rays are emitted evenly from the whole cell and react with the fluorescent substance 45 so to eventually emit visible rays.

The front electrode illustrated in FIG. 5 provides advantages of decreasing production costs and the number of processes due to an omission of the transparent electrode formation.

As mentioned in the above, the bus electrode 32 includes the terminal electrode 32A, the main electrode 32B and the branch electrode 32C, and the other bus electrode 33 includes the same types of the electrodes 33A, 33B and 33C. As the bus electrodes are constituted as the above, areas for emitting the visible rays become smaller compared to the case of using the transparent electrode since the area of the electrodes blocking the visible rays emitted from the entire cell becomes large. That is, the opening ratio decreases.

To complement the above problem, the area for emitting the visible rays should be enlarged as much as possible. An area of the fluorescent substance 45 increases by adopting the hexagonal barrier rib 44.

Accordingly, the barrier rib had different structures, that is, the hexagonal barrier rib structure is adopted to solve the above problem.

Figure 6A:
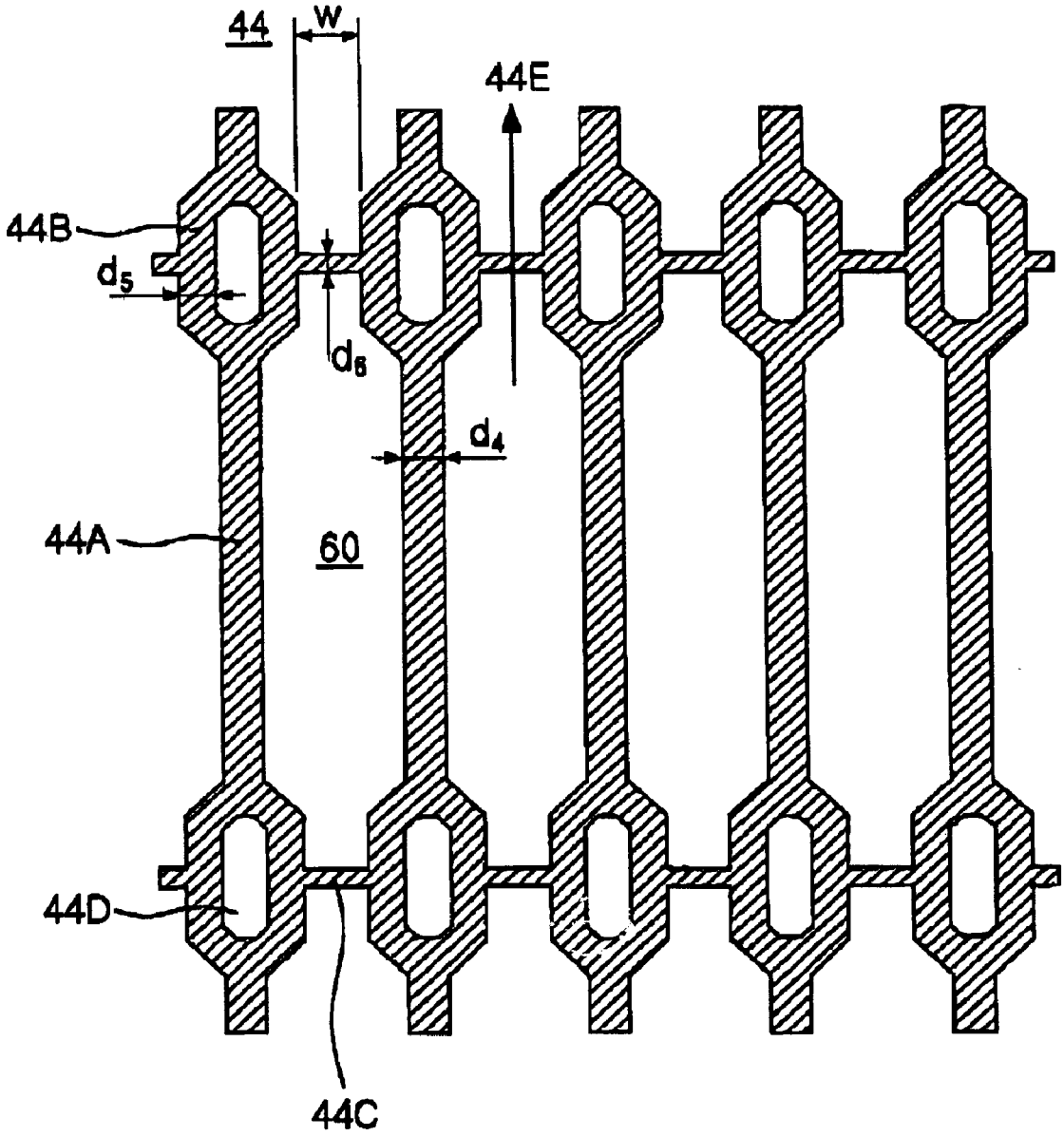
FIGS. 6A and 6B are detailed diagrams showing a hexagonal barrier rib of FIG. 4.
Figure 6B:
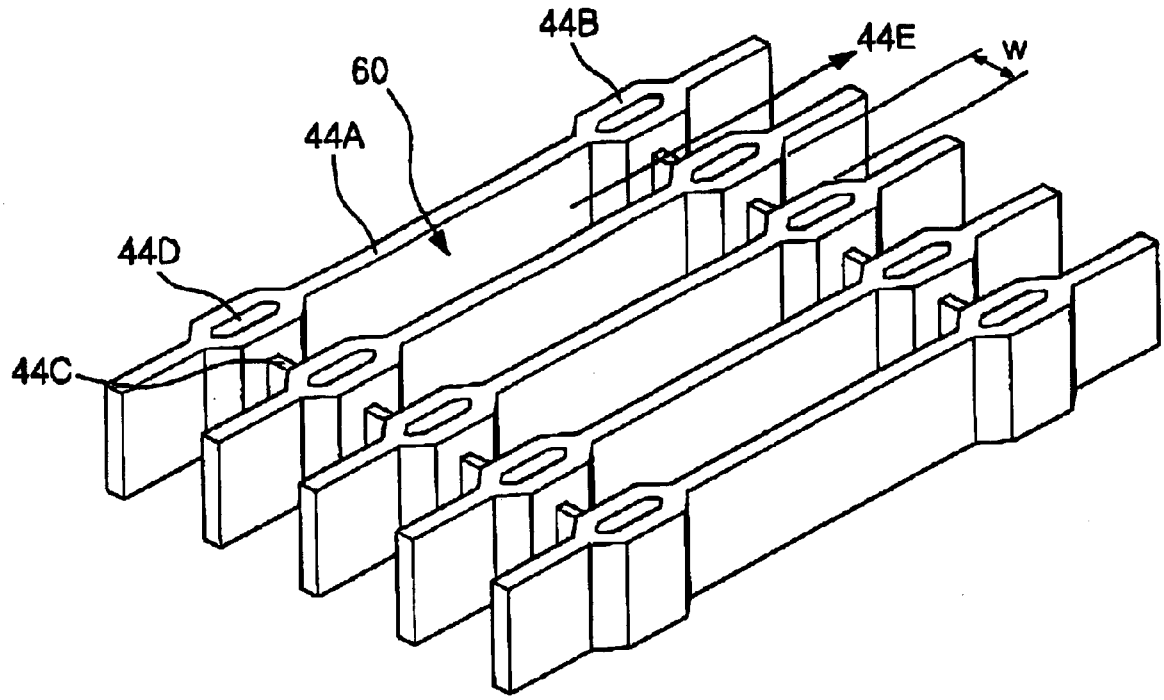

FIGS. 6A and 6B are detailed diagrams showing the hexagonal barrier rib of FIG. 4. FIG. 6A is a cross-sectional view of the hexagonal barrier rib, and FIG. 6B is a perspective view of the hexagonal barrier rib.

Referring to FIGS. 6A and 6B, the hexagonal barrier rib 44 defining a hexagonal discharge cell region 60 includes a vertical barrier 44A for preventing charge movements between left and right unit discharge cells being formed with a stripe shape, a connection barrier rib 44B connecting each vertical barrier rib 44A located between upper and lower unit discharge cell and providing a length of the horizontal barrier rib 44C shorter than an isolation distance between the vertical barrier ribs 44A by having a groove 44D at a central portion of the connection barrier rib 44B and the horizontal barrier rib 44C connecting each of the neighboring connection barrier ribs 44B and preventing charge movements between the upper and lower unit discharge cells. Eventually, the unit discharge cell has a hexagonal structure including the vertical barrier rib 44A, the connection barrier rib 44B and the horizontal barrier rib 44C. By surrounding the whole discharge cell with the barrier rib, erroneous discharges occurring between the discharge cells in all directions are maximally suppressed.

With respect to each barrier rib, the vertical barrier rib 44A is a barrier rib where the discharge is taken place and defines the unit discharge cell region where an actual discharge is taken place. The connection barrier rib 44B is a barrier rib vertically connecting each vertical barrier rib 44A defining the unit discharge cell region, and a groove 44D is formed at a central portion of the connection barrier rib 44B for maintaining a uniform thickness. Also, the horizontal barrier rib 44C provides a gas-passing path 44E during an exhaust process and a gas supplying process since the height of the horizontal barrier rib 44C is lower than that of the vertical barrier rib 44A and the connection barrier rib 44B.

Meanwhile, the groove 44D of the connection barrier rib 44B is to minimize a thickness of the path for passing gas during the exhaust process and the gas supplying process. A line width $d_4$ of the vertical barrier rib 44A is identical to that ds of the connection barrier rib 44B. A line width $d_6$ of the horizontal barrier rib 44C is smaller compared to the line width $d_4$ of the vertical barrier rib 44A and that $d_5$ of the connection barrier rib 44B.

With respect to the horizontal barrier rib 44C, a top portion of the horizontal barrier rib 44C has a concave surface, which causes the horizontal barrier rib 44C to have a height lower than the vertical barrier rib 44A. The reason for the horizontal barrier rib 44C to have a smaller line width and a lower height is to provide the gas-passing path 44E. When forming a barrier rib pattern, the line width of the horizontal barrier rib 44C is designed to have about 60% to about 70% of an line width of the vertical barrier rib 44A and the connection barrier rib 44B so that the height of the horizontal barrier rib 44C is lowered after completing an annealing process due to a shrinkage difference according to the width during the annealing. It is verified that there is a height difference of about 3 $\mu$m to about 5 $\mu$m after annealing at around 550° C. for approximately 10 minutes.

The hexagonal barrier rib 44 and the front substrate described in FIG. 3 are joined and sealed together. At this time, the hexagonal barrier rib 44 is in a form of encompassing four sides of the discharge cell region 60, thereby preventing the optical cross-talk phenomenon occurring between the discharge cells. Also, the gas-passing path 44E is formed between the horizontal barrier rib 44C and an upper side of the discharge cell region 60. The gas-passing path 44E forms a channel for flowing air. This structure enables remaining gas to be exhausted to outside. Also, this structure makes it possible to add simultaneously discharge gas to the discharge cell region 60.

Meanwhile, a width W of the gas-passing path 44E provided to an upper portion of the horizontal barrier rib 44C is controlled by the groove 44D formed at the center of the connection barrier rib 44B. For instance, in case that the width W of the gas-passing path 44E is wide, that is, a length of the horizontal barrier rib 44C is long, gas can flow more freely. In spite of this advantage, there exist disadvantages that charge can easily move into a space between the upper and lower discharge cells. Also, in case of performing the annealing process for a long period to obtain a wide width, a height is instead lowered extensively to make the barrier rib being fall off. If the width W of the gas-passing path 44E is too narrow, gas flowing is limited, but amounts of charge movements substantially decrease, thereby preventing erroneous discharges.

For this reason, the width W of the gas-passing path 44E is set to be such a width allowing gas to be easily exhausted. Also, it is prefer for the width W to be narrower in order to prevent erroneous discharges between the upper and lower discharge cells. As explained, if the width W of the gas-passing path 44E is narrow, it is possible to block charge movements due to upper and lower discharges, further meaning that a distance between electrodes of non-discharge regions can be decreased. As a result, it is possible to increase an area of the discharge cell responsible for emitting visible rays. Hence, the present invention is implemented with the hexagonal barrier rib 44 proposed for narrowing the width W of the gas-passing path 44E until having a width allowing the structure of the barrier rib 44 to be retained without being fall off.

The hexagonal barrier rib in accordance with the present invention is not limited to the discharge cell region merely for one color, but is broadly applicable to the discharge cell regions for other various colors.

Figure 7A:
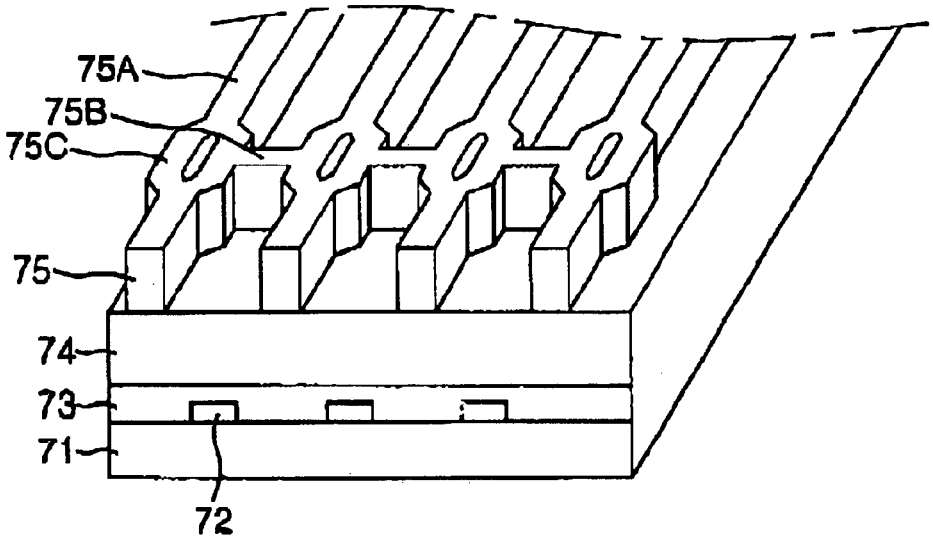
FIGS. 7A to 7C are cross-sectional views illustrating a method for forming the hexagonal barrier rib.
Figure 7B:
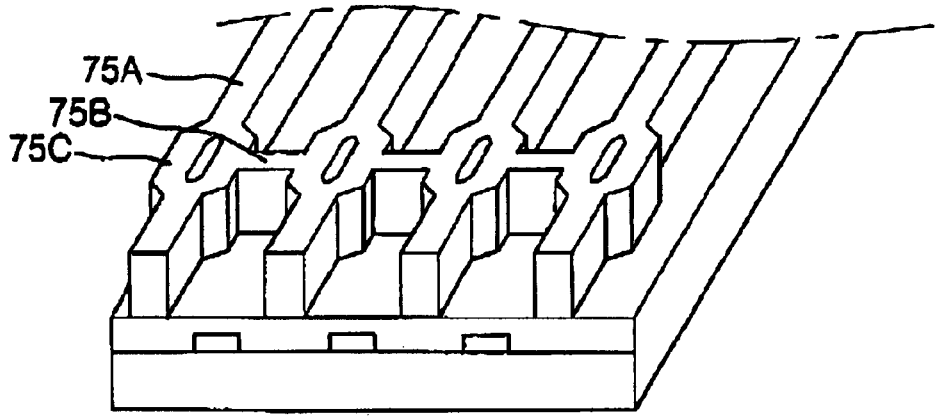
Figure 7C:
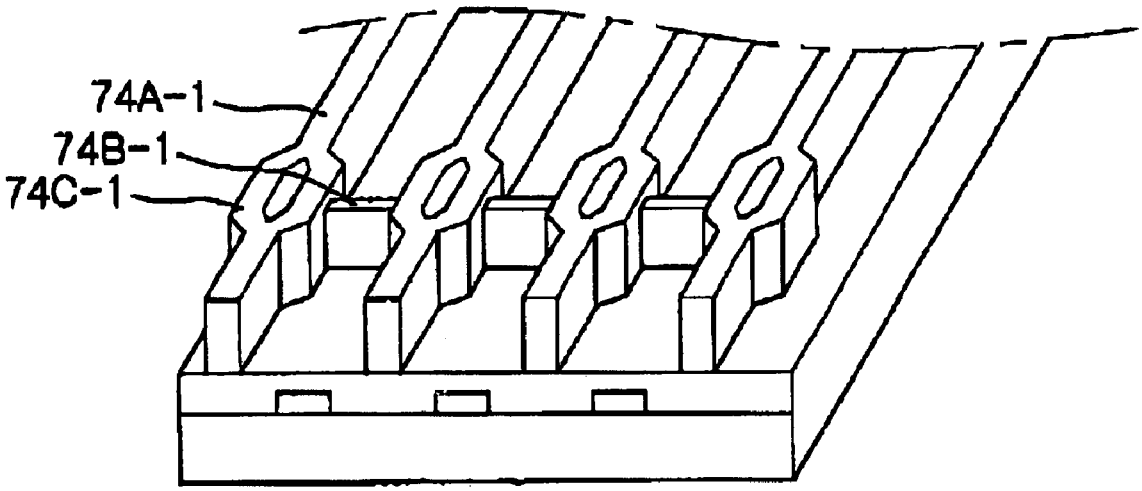

FIGS. 7A to 7C are cross-sectional views illustrating a method for forming the hexagonal barrier rib.

Referring to FIG. 7A, an address electrode 72 is formed on a rear substrate 71, and a dielectric layer 73 is formed thereon. Then, a photosensitive barrier rib substance 74 overlies the dielectric layer 73, and a photo-mask 75 is formed thereon. At this time, the photo-mask 75 includes a vertical pattern 75A and a horizontal pattern 75B and a connection pattern 75C for connecting the vertical pattern 75A to the horizontal pattern 75B. Herein, a groove is formed at a center of the connection pattern 75C. The vertical pattern 75A, the horizontal pattern 75B and the connection pattern 75C are in a hexagonal shape corresponding to the hexagonal barrier rib. Both the vertical pattern 75A and the horizontal pattern 755 have the identical width. However, each width of the vertical pattern 75A and the connection pattern 75C is wider than the width of the horizontal pattern. Also a length of the vertical pattern 75A is longer than that of the horizontal pattern 75B.

With reference to FIG. 7B, the photosensitive barrier rib substance 74 is photo-exposed and developed with use of the photo-mask 75, which is, in turn, removed. Non-photo-exposed portions of the photosensitive barrier rib substance 74 correspond to the photo-mask 75 and become the vertical barrier rib pattern 74A, the horizontal barrier rib pattern 74B and the connection barrier rib pattern 74C. Photo-exposed portions of the photosensitive barrier rib substance 74 are subsequently removed. At this time, the vertical barrier rib pattern 74A and the connection barrier rib pattern 74C have the identical width. However, each width of the vertical barrier rib pattern 74A and the connection barrier rib pattern 74C is wider than the width of the horizontal barrier rib 74C. A length of the vertical barrier rib 74A is longer than that of the horizontal barrier rib 74C.

Referring to FIG. 7C, the photosensitive barrier rib substance 74 including the vertical barrier rib pattern 74A, the horizontal barrier rib pattern 74B and the connection barrier rib 74C is proceeded with an annealing process carried out at a temperature of around 550° C. for about 20 minutes. After the annealing process, a hexagonal barrier rib including a vertical barrier rib 74A-1, a horizontal barrier rib 745-1 and a connection barrier rib 74C-1, is formed. At this time, the horizontal barrier rib pattern 74B having a narrower width is much shrunk than the vertical barrier rib having a wider width due to a shrinkage difference based on the different width, and thus, a height of the horizontal barrier rib 74B-1 is lower than that of the vertical barrier rib 74A-1. Also, since the width of the connection barrier rib pattern 74C is identical to that of the vertical barrier rib pattern 74A, the connection barrier rib pattern 74C has the identical shrinkage level of the vertical barrier rib pattern 74A. As a result, a height of the connection barrier rib 74C-1 is identical to that of the vertical barrier rib 74A-1.

FIGS. 7A to 7C illustrates a method for forming the hexagonal barrier rib through the use of photolithography. However, it is still possible to employ a sand blast method to form the hexagonal barrier rib provided from the present invention.

In accordance with the sand blast method, a rib paste, i.e., a material for the barrier rib is coated with a predetermined thickness on a rear substrate providing an address electrode and a dielectric layer and dried thereafter. A dry film resist (DFR) makes a junction with a surface of the above dried rib paste, and subsequently a photo-mask having a hexagonal barrier rib pattern is used to proceed a sand blast process through a photo-exposure process and a developing process. Then, the rib paste is polished, and the rest, i.e., non-polished portions provide the hexagonal barrier rib pattern. The hexagonal barrier rib pattern is annealed to provide a hexagonal barrier rib.

In the above-described method for forming the hexagonal barrier rib, the photo-mask includes patterns corresponding to the hexagonal barrier rib, and one sequential cycle of a photo-exposure process, a developing process and an annealing process is carried out to form the hexagonal barrier rib. However, the vertical barrier rib, the connection barrier rib and the horizontal barrier rib can be separately proceeded with the photo-exposure and the developing processes, and the annealing process is subsequently applied all at once.

Eventually, the hexagonal barrier rib 44 of the surface discharge AC type PDP in accordance with the present invention is formed by using either the photolithography or the sand blast method. In the horizontal barrier rib of the hexagonal barrier rib, the gas-passing path is formed to allow a free flow of exhaust gas and an ease of adding discharge gas.

As mentioned in the above, a cell defined in accordance with the present invention is divided into a discharge region and a non-discharge region. The barrier rib, particularly, the horizontal barrier rib is formed even in the non-discharge region to increase areas of the discharge cell. This arrangement reduces maximally charge movements between upper and lower cells, thereby enabling the enlargement of the discharge cell.

Also, when the pair of bus electrodes 32 and 33 is used to generate discharge without employing the transparent electrode, the pair of the bus electrodes 32 and 33 is mandated to act as the transparent electrode. This fact means that the discharge should be extended to the whole cell only using the pair of the bus electrodes 32 and 33. This fact further means that the pair of the bus electrodes 32 and 33 needs a width as same as of the transparent electrode. However, in case that the pair of the bus electrodes 32 and 33 has the width identical to the transparent electrode, an area for emitting visible rays becomes very small, resulting in a decrease of brightness. This disadvantage is a main factor that the discharge cannot be generated by merely using the pair of the bus electrodes 32 and 33.

Therefore, the present invention adopts a structure wherein an opening ratio of the visible ray emission increases and the discharge can extend to the whole discharge cell region. In order to maximally reduce an occupying area of the pair of the bus electrodes 32 and 33, the main electrodes 32B and 33B for generating the discharge, the terminal electrodes 32A and 33A for connecting terminal parts to the branch electrodes 32C and 33C are formed in central portions of the cell. With this structure, the discharge initiated around a discharge gap is extended to the whole cell through the branch electrode 32C and 33C. As decreasing a line width of each electrode, the opening ratio conversely increases. However, the discharge area decreases, resulting in instable discharge. This instable discharge inversely causes a decrease of brightness.

The discharge occurs differently in accordance with each line width of the main electrodes 32B and 333 and the branch electrodes 32C and 33C. As the line width of the main electrode 32B and 33B increase, the discharge becomes more stable, but inversely resulting in a decrease of the brightness due to a decrease of the opening ratio. However, as the line width of the main electrodes 32B and 33B decrease, the discharge become unstable, resulting in a decrease of uniformity in the whole panel due to occurrences of erroneous discharge.

In case of connecting each end terminal of the panel without using the branch electrode 32C and 33C, the discharge cannot be extended to the whole cell, and a discharge voltage also increases. Hence, it is required to place the branch electrodes 32C and 33C in central portions of the cell. Also, the line width of the electrode decreases as much as possible to increase the opening ratio.

In accordance with the present invention, the discharge occurs only with the pair of the bus electrodes 32 and 33, and ultraviolet rays emitted from the discharge react with the fluorescent substance to emit visible rays. At this time, since an area of the electrode blocking the visible rays emitted from the whole areas is larger than the area of the cell using the transparent electrode, the area responsible for the visible ray emission decreases compared to the case of using the transparent electrode. That is, the opening ratio decreases. To complement this problem, the area for emitting the visible rays is required to be enlarged. The present invention provides an approach of solving the above-described problem by increasing an area of the fluorescent substance. That is, the whole cell is set to be encompassed by the hexagonal barrier rib and coated with the fluorescent substance. This set provides an effect of emitting the visible rays even from surfaces of the barrier rib, which were not used in the prior art. This fact further means that it is possible to obtain the opening ratio even when solely using the pair of the bus electrodes 32 and 33.

In case of using the barrier rib in a typical stripe shape, a distance between the electrodes of the upper and lower discharge cells is set to be large in order to prevent occurrences of erroneous discharge between the upper and lower discharge cells. However, this compensation conversely results a disadvantage that the size of the discharge cell actually shown decreases. To solve this problem, it is attempted in this invention to use the hexagonal barrier rib so to increase the distance between the electrodes. As a result, the size of the actually shown discharge cell is increased, resulting in an increase of the brightness.

In addition to the effect of increasing the brightness through the use of the hexagonal barrier rib, only the pair of the bus electrodes 32 and 33 is used without the transparent electrodes included in the front panel so to be substituted for black stripes employed for improving contrast. This substitution provides another effect of simplifying the process. That is, the front panel can be formed only through three processes for forming the pair of the bus electrodes 32 and 33, the transparent dielectric layer 34 and the protection layer 35. This simplified process makes it possible to reduce costs for materials and to enhance massproduction.

In case of using only the pair of the bus electrodes 32 and 33 without the transparent electrode, there is a problem of decreasing the brightness. Particularly, in the present invention, the discharge area is expanded in more extents by decreasing the distance between the upper and lower discharge cells. Also, since the pair of the bus electrodes 32 and 33 is substituted for the black stripe, it is possible to establish a structure for maximizing the brightness. As a result, it is possible to obtain nearly identical when using the transparent electrode. Also, this substitution enhances a contrast function.

The present invention provides several advantages as the following. First, it is possible to simplify the process related to the front panel because the surface discharging AC type PDP in accordance with the present invention employs only the pair of the bus electrodes without the transparent electrodes.

Also, the entire discharge cell is encompassed by the hexagonal barrier rib and coated with the fluorescent substance as to increase the brightness. Even when using the pair of the bus electrodes 32 and 33, the opening ratio of this case is nearly identical to the case of using a panel with the transparent electrode.

Furthermore, the hexagonal barrier rib adopted in the present invention prevents a chance of occurring erroneous discharge. It is also possible to improve an exhaust efficiency by forming the gas-passing path in a top portion of the horizontal barrier rib.

While the present invention has been described with respect to certain preferred embodiments, it will be apparent to those skilled in the art that various changes and modifications may be made without departing from the scope of the invention as defined in the following claims.

What is claimed is:

1. A plasma display panel (PDP), comprising:

a vertical barrier rib and a horizontal barrier rib, wherein the vertical barrier rib and the horizontal barrier rib form a hexagonal shape to encompass discharge cell region in all directions;

a connection barrier rib connecting the vertical barrier rib to the horizontal barrier rib, wherein the connection barrier rib have a groove at a central portion thereof so that a length of the horizontal barrier rib it shorter than a distance between the vertical barrier ribs; and a gas-passing path formed above a top surface of the horizontal barrier rib of which height is lowered with respect to a surface of the vertical barrier rib, wherein the horizontal barrier rib prevents erroneous discharge in a vertical direction, the vertical barrier rib prevents erroneous discharge in a horizontal direction and the vertical barrier rib, the horizontal barrier rib and the connection barrier rib are connected to each other to provide a hexagonal discharge cell region.

2. The PDP as recited in claim 1, wherein a line width of the vertical barrier rib is identical to the line width of the connection barrier rib, and a line width of the horizontal barrier rib is smaller than each line width of the vertical barrier rib and the connection barrier rib.

3. The PDP as recited in claim 1, wherein a size of the groove of the connection barrier rib is controlled so that the connection barrier rib has a consistent thickness and the line width of the vertical barrier rib is identical to the line width of the vertical barrier rib.

4. The PDP as recited in claim 1, wherein the connection barrier rib is formed in a hexagonal shape by having a groove at a central portion of the connection barrier.

5. A surface discharging alternating current (AC) type plasma display panel (PDP) with three electrodes, comprising:

a pair of front electrodes; and an address electrode, wherein each front electrode of a unit discharge device, including:

a main electrode and a terminal electrode being paired by having a uniform distance in a direction of making a perpendicular cross at a center of the barrier rib; and a branch electrode connecting the main electrode to the terminal electrode by being formed in a parallel direction to the barrier rib at the center of the barrier rib, wherein each line width of the main electrode, the terminal electrode and the branch electrode is different, and the main electrode, the terminal electrode and the branch electrode are bus electrodes without having a transparent electrode.

6. The PDP as recited in claim 5, wherein the main electrodes of the pair of the front electrodes are arranged to face each other so to form a discharge gap.

7. The PDP as recited in claim 5, wherein a line width of the branch electrode is smaller than each line width of the main electrode and the terminal electrode.

8. The PDP as recited in claim 5, wherein each line width of the main electrode, the terminal electrode and the branch electrode ranges from about 60 $\mu$m to about 80 $\mu$m.

9. A plasma display panel, comprising a unit discharge device, wherein the unit discharge device includes:

a front substrate and a rear substrate;

a pair of bus electrodes in a trapezoidal shape by being formed in a first direction on the front substrate;

an address electrode formed on the rear substrate in a second direction of making a cross with the pair of the bus electrodes;

a dielectric layer forming on the rear substrate including the address electrode;

a hexagonal barrier rib encompassing a discharge cell region defined by the pair of the bus electrodes Sand the address electrode and providing a gas-passing path due to a fact that a height of one side of the barrier rib is lower than that of the other side of the barrier rib; and a fluorescent substance coated on an entire area of the discharge cell region encompassed by the hexagonal barrier rib.

10. The PDP as recited in claim 9, wherein each bus electrode includes:

a main electrode and a terminal electrode being arranged in a first direction with a predetermined distance; and a branch electrode connecting the main electrode to the terminal electrode by being formed in a parallel direction to the gas-passing path provided from the hexagonal barrier rib and having a line width at least smaller than that of the main electrode.

11. The PDP as recited in claim 10, wherein the main electrodes of the pair of front electrodes form a discharge gap by being arranged to face each other.

12. The PDP as recited in claim 9, wherein the hexagonal barrier rib includes:

a vertical barrier rib having a stripe shape and being arranged in a second direction;

a horizontal barrier rib being arranged in a direction of crossing the vertical barrier rib and providing the gas-passing path by having a height lower than the height of the vertical barrier rib; and a connection barrier rib connecting the vertical barrier rib to the horizontal barrier rib and being formed with a groove at a center of the connection barrier to narrow a width of the gas-passing path.

13. The PDP as recited in claim 12, wherein a line width of the connection barrier rib is identical to that of the vertical barrier rib, and a line width of the horizontal barrier rib is smaller than that of the vertical barrier rib.

* * * * *